US012595939B2

(12) United States Patent
Guia et al.

(10) Patent No.: US 12,595,939 B2
(45) Date of Patent: Apr. 7, 2026

(54) DILUTION REFRIGERATION DEVICE AND METHOD

(71) Applicant: L'Air Liquide, Societe Anonyme pour l'Etude et l'Exploitation des Procedes Georges Claude, Paris (FR)

(72) Inventors: Olivier Guia, Sassenage (FR); Marc Stora, Sassenage (FR)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 315 days.

(21) Appl. No.: 18/267,337

(22) PCT Filed: Nov. 30, 2021

(86) PCT No.: PCT/EP2021/083494
§ 371 (c)(1),
(2) Date: Jun. 14, 2023

(87) PCT Pub. No.: WO2022/128433
PCT Pub. Date: Jun. 23, 2022

(65) Prior Publication Data

US 2024/0053066 A1 Feb. 15, 2024

(30) Foreign Application Priority Data

Dec. 18, 2020 (FR) ..... 2013598

(51) Int. Cl.
*F25B 9/12* (2006.01)

(52) U.S. Cl.
CPC ..... *F25B 9/12* (2013.01); *F25B 2500/13* (2013.01)

(58) Field of Classification Search
CPC .... F17C 3/08; F17C 3/085; F17C 2227/0353; F25B 2309/1427; F25B 2309/1412;
(Continued)

(56) References Cited

U.S. PATENT DOCUMENTS 9,234,691 B2 * 1/2016 Black ..... F25B 9/145
10,113,793 B2 * 10/2018 Simmonds ..... F25J 3/08
(Continued)

FOREIGN PATENT DOCUMENTS

FR 2 914 050 9/2008
JP 2007 333 273 12/2007

OTHER PUBLICATIONS

International Search Report and Written Report for PCT/EP2021/083494, mailed Feb. 14, 2022.
(Continued)

*Primary Examiner* — Nelson J Nieves
(74) *Attorney, Agent, or Firm* — Justin K. Murray

(57) ABSTRACT

Disclosed is a dilution refrigeration device comprising a working circuit, a mixing chamber, a still and a transfer component, a circuit configured to connect an outlet of the mixing chamber to an inlet of the still and an outlet of the still to an inlet of the transfer component, the circuit also being configured to connect an outlet of the transfer component to an inlet of the mixing chamber, the device further comprising at least one cooling component in thermal exchange with the working circuit, the at least one cooling component comprising a cryogenerator, the device comprising a support, a sealed enclosure, with an open end of the enclosure being mechanically connected to the support via a sealed flexible bellows, an upper end of the cryogenerator being fixed on the support, the device further comprising a sealed sheath housed in the enclosure, a lower end of the cryogenerator extending into the sheath inside the bellows so that the enclosure and the sheath are at least partially mechanically isolated from the vibrations generated by the cryogenerator, the circuit comprising a fluid injection duct connecting an outlet of the transfer component to an inlet of the mixing chamber via a sealed passage in the sheath, the injection duct being in thermal exchange with the cryogen-
(Continued)

erator and being mechanically decoupled from the cryogenerator and the support, i.e. the injection duct is at least partially mechanically isolated from the vibrations generated by the cryogenerator.

14 Claims, 2 Drawing Sheets

(58) Field of Classification Search
CPC ..... F25B 2309/1414; F25B 2309/1417; F25B 2309/1421; F25B 9/12; F25B 9/14; F25B 9/145; F25B 2500/13
See application file for complete search history.

(56) References Cited

U.S. PATENT DOCUMENTS 10,876,769 B2 * 12/2020 Yamada ..... F25B 9/14
2006/0021355 A1 * 2/2006 Boesel ..... F25D 19/00 62/51.1
2014/0202174 A1 7/2014 Wang
2014/0290277 A1 * 10/2014 Yamada ..... F25B 9/14 62/6
2018/0051852 A1 * 2/2018 Wikus ..... F25D 19/006
2021/0065945 A1 * 3/2021 Ma ..... H01F 6/006
2021/0231349 A1 * 7/2021 Zhou ..... C22C 13/00
2021/0402407 A1 * 12/2021 Hoehne ..... F25B 9/12
2024/0053066 A1 * 2/2024 Guia ..... F25B 9/12
2024/0093916 A1 * 3/2024 Guia ..... F25B 41/40

OTHER PUBLICATIONS

French Search Report for FR 2 013 598, mailed Aug. 12, 2021.
Uhlig, K. et al., "3He/4He dilution refrigerator precooled by Gifford-McMahon refrigerator," Cryogenics, Elsevier, Kidlington, GB, vol. 37, No. 5, May 1, 1997, pp. 279-282.

* cited by examiner

[Fig. 1]
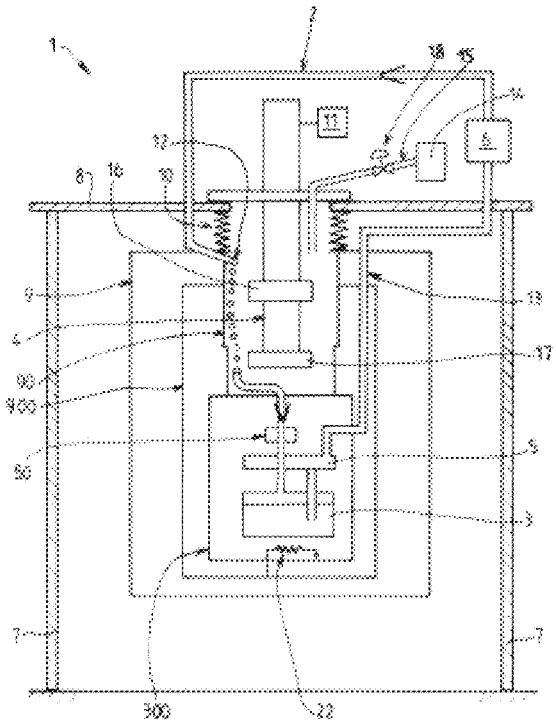
[Fig. 2]
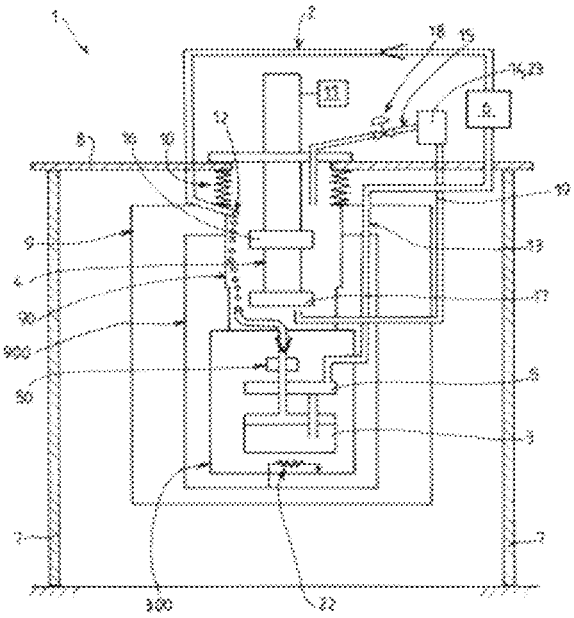

[Fig. 3]
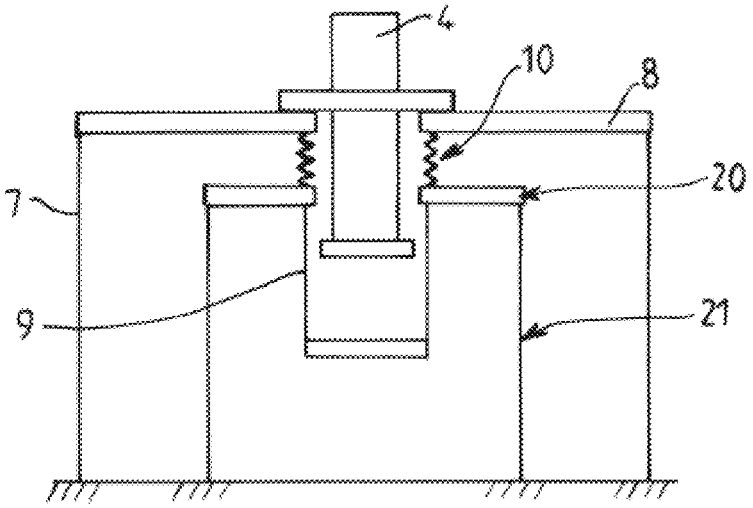

DILUTION REFRIGERATION DEVICE AND METHOD

CROSS REFERENCE TO RELATED APPLICATIONS

This application is a § 371 of International PCT Application PCT/EP2021/083494, filed Nov. 30, 2021, which claims the benefit of FR2013598, filed Dec. 18, 2020, both of which are herein incorporated by reference in their entireties.

FIELD OF THE INVENTION

The invention relates to a dilution refrigeration device and method.

The invention relates in particular to a low-temperature or very-low-temperature (meaning potentially down to the temperature range from one to around 100 millikelvin) cryogenic refrigeration device and method.

BACKGROUND OF THE INVENTION

Indeed, the traditional means of obtaining the refrigeration power at temperatures of around one millikelvin to around 100 millikelvin is the helium-3/helium-4 dilution refrigerator.

Document FR2914050A1 describes a cryogenerator-type cooling system used in a dilution refrigeration device.

The coupling (thermal and mechanical link) of a cryogenerator with a dilution refrigeration device is, however, likely to transmit vibrations to the dilution refrigeration device. These vibrations are harmful because they give rise to overconsumption of power or overheating and parasitic noises on the object cooled by the dilution refrigeration device.

An aim of the present invention is to overcome all or some of the drawbacks of the prior art set out above.

SUMMARY OF THE INVENTION

In certain embodiments, the invention relates more particularly to a dilution refrigeration device comprising a working circuit in the form of a loop containing a cycle fluid, the cycle fluid comprising a mixture of helium-3 (3He) and helium-4 (4He), the working circuit comprising a mixing chamber, a boiler and a transfer member, which are disposed in series and fluidically connected via a set of lines, the set of lines of the circuit being configured to connect an outlet of the mixing chamber to an inlet of the boiler and an outlet of the boiler to an inlet of the transfer member, the set of lines of the circuit also being configured to connect an outlet of the transfer member to an inlet of the mixing chamber, the device further comprising at least one cooling member which is in heat exchange with the working circuit and is configured to transfer cold energy to the cycle fluid, the at least one cooling member comprising a cryogenerator, for example of the Gifford-McMahon or pulse tube type.

In an effort to overcome the deficiencies of the prior art discussed supra, the device according to the invention, which is otherwise in accordance with the generic definition thereof given in the above preamble, can include a support, a fluid-tight enclosure, an open end of the enclosure being mechanically connected to the support via a fluid-tight flexible bellows, an upper end of the cryogenerator being fixed to the support, the device further comprising a fluid-tight sheath housed in the enclosure, a lower end of the cryogenerator extending in the sheath inside the bellows such that the enclosure and the sheath are at least partially mechanically insulated from vibrations generated by the cryogenerator, the circuit comprising a fluid injection line connecting an outlet of the transfer member to an inlet of the mixing chamber via a fluid-tight passage in the sheath, the injection line being in heat exchange with the cryogenerator and being mechanically decoupled from the cryogenerator and from the support, that is to say that the injection line is at least partially mechanically insulated from the vibrations generated by the cryogenerator.

The dilution refrigerator according to the invention therefore operates with a cryogenerator, without the cold dilution part being subjected or too sensitive to the vibrations of the cryogenerator.

Furthermore, embodiments of the invention may comprise one or more of the following features:

- the injection line is fixed to an inner wall of the sheath and/or suspended in the sheath,
- the circuit comprises a return line connecting an outlet of the boiler to an inlet of the transfer member outside the sheath, via a fluid-tight passage in the enclosure, the return line being mechanically decoupled from the cryogenerator and from the support, that is to say at least partially mechanically insulated from the vibrations generated by the cryogenerator,
- the return line is in heat exchange with the injection line and/or with at least one heat exchanger in heat exchange with the injection line in order to transfer cold energy from the cycle fluid circulating in the return line to the cycle fluid circulating in the injection line,
- the mixing chamber and the boiler are mounted in a shell and/or a container that are/is located in the enclosure, the transfer member being located outside the enclosure,
- the device comprises a source of gas comprising helium-4 (4He) located outside the enclosure and a supply line connecting said source of gas to the inside of the sheath in a fluid-tight manner,
- the supply line comprises a member for controlling the gas flow rate configured to control the quantity of gas in the sheath,
- the device comprises a return line connecting the sheath to the source of gas and a member for circulating the gas in order to generate a looped dynamic stream in sheath via the supply line and return line,
- in an operating configuration, the lower end of the cryogenerator comprises a first portion cooled to a first temperature of between 4 and 100 K and for example equal to 50 K, and a second portion cooled to a second temperature of between 2 and 8 K and for example equal to 4 K,
- the at least one cooling member comprises an additional cooling system located at the inlet upstream of the boiler, for example a cooler (50) of the Joule-Thomson type,
- the support comprises a first base mounted on a first set of legs, for example three legs,
- the support comprises a second base located under the first base and mounted on a second set of legs, for example three legs, the two ends of the bellows being connected respectively to the first base and second base,
- the enclosure is mechanically connected to the second base.

In another embodiment, the invention also relates to a dilution refrigeration method using a device according to any one of the features above or below, comprising a step of generating cold by way of the cryogenerator, a step of circulating the cycle fluid in the working circuit, the method further comprising at least one step from among:

regulating the quantity of gas in the sheath, regulating the pressure in the sheath to a determined value, for example close to atmospheric pressure and notably between 0 and 2 bar, regulating the pressure in the sheath to a pressure corresponding to the liquefaction pressure of helium-4 at the coldest temperature of the cryogenerator.

The invention may also relate to any alternative device or method comprising any combination of the features above or below within the scope of the claims.

BRIEF DESCRIPTION OF THE DRAWINGS

These and other features, aspects, and advantages of the present invention will become better understood with regard to the following description, claims, and accompanying drawings. It is to be noted, however, that the drawings illustrate only several embodiments of the invention and are therefore not to be considered limiting of the invention's scope as it can admit to other equally effective embodiments.

FIG. 1 shows a schematic and partial view illustrating a first possible example of the structure and operation of a device according to the invention, FIG. 2 shows a schematic and partial view illustrating a second possible example of the structure and operation of a device according to the invention, FIG. 3 shows a simplified, schematic and partial view illustrating another example of a support structure of such a device.

DETAILED DESCRIPTION OF THE INVENTION

The dilution refrigeration device 1 illustrated in [FIG. 1] comprises a working circuit 2 in the form of a loop containing a cycle fluid. This cycle fluid comprises a mixture of helium-3 (3He) and helium-4 (4He).

This working circuit 2 forms, for example, a closed loop and comprises a mixing chamber 3, a boiler 5 and a transfer member 6 (for example a pump or other device), which are disposed in series and connected fluidically via a set of lines 12, 13. The set of lines of the circuit 2 is in particular configured to connect an outlet of the mixing chamber 3 to an inlet of the boiler 5 and an outlet of the boiler 5 to an inlet of the transfer member 6.

In addition, the set of lines of the circuit is also configured to connect an outlet of the transfer member 6 to an inlet of the mixing chamber 3. Conventionally, a heat exchange portion (not shown for the sake of simplification) may be provided between the countercurrent lines between the mixing chamber and the boiler.

The device 1 further comprises at least one cooling member which is in heat exchange with the working circuit 2 and which is configured to transfer cold energy to the cycle fluid (that is to say to cool said cycle fluid by supplying cooling power to it).

Such a dilution system makes it possible to generate very low temperatures at the mixing chamber 3. This can be used conventionally to cool an application (shown schematically by the reference 22) and which can notably have a power to be dissipated that varies over time.

Temperatures in the range between one millikelvin and 100 millikelvin can notably be achieved.

The cooling member comprises a cryogenerator 4, for example of the Gifford-McMahon or pulse tube type (but any other suitable cryogenic cold production unit can be envisaged).

The device 1 comprising a support 7, 8 and a fluid-tight enclosure 9.

The enclosure 9 comprises, for example, a fluid-tight tank (typically made of stainless steel, aluminum, or any other suitable material) having an open end connected to the support 7, 8 in a mechanical and fluid-tight manner via a fluid-tight flexible bellows 10. The flexible bellows 10 is for example formed of corrugations made of hydroformed stainless steel. Of course, any other type of vibration damping and/or filtering connection could replace or supplement the aforementioned bellows 10, for example edge welded bellows or an elastomer sleeve. For example, the support comprises a base 8 which is horizontal in a use position and which is mounted on a first set of legs 7, for example three legs 7.

The cryogenerator 4 is fixed to the support 7, 8, for example by screwing.

As illustrated, an upper end of the cryogenerator 4 can be mounted on the base 8 of the support (notably in a fluid-tight manner through the base 8).

The device 1 further comprises a fluid-tight sheath 90 that is housed in the enclosure 9 and that also forms a fluid-tight closed volume.

For example, the internal volume of the enclosure 9 is under vacuum (at a pressure lower than the external pressure).

For example, the sheath 90 comprises or is made up of a fluid-tight metallic tank or shell. The sheath 90 is for example fixed to an upper end of the enclosure 9. For example, an open upper end of the sheath 90 is suspended or connected to an upper end of the enclosure 9 (if necessary via a connection or a vibration damping element). A lower end of the cryogenerator 4 extends in the sheath 90 inside the bellows 10 (and therefore in the enclosure 9 which houses them).

According to this arrangement, the enclosure 9 and the sheath 90 (and the components they contain) are at least partially mechanically insulated from the vibrations generated by the cryogenerator 4 (by virtue notably of the bellows 10).

The mixing chamber 3 and the boiler 5 can be housed/mounted in a fluid-tight shell 900 located in the enclosure 9 and notably in a container 300 housed in this shell 900.

The transfer member 6 is located outside the enclosure 9. For example, the volume of the shell 900 forms a volume which may or may not communicate with the volume of the sheath 90.

Preferably, the volumes of the enclosure 9, of the shell 900 and of the container 300 are under vacuum and communicate with each other but do not communicate with the volume of the sheath 90 which is under an independent atmosphere (the volume of the sheath 90 contains for example at least one from among: He3, He4). The working circuit 2 comprises a cycle fluid injection line 12 (which may be a cupronickel or copper capillary, for example) connecting an outlet of the transfer member 6 to an inlet of the mixing chamber 3 via a (fluid-tight) passage in the sheath 90 and in the enclosure 9. The injection line 12 is in heat exchange with the cryogenerator 4 (which cools it). For example, the cryogenerator 4 comprises plates and/or cooling exchangers 16, 17 in contact with cold parts of the cryogenerator 4.

For example, in the operating configuration, the lower end of the cryogenerator 4 in the sheath 90 comprises a first portion 16 (first stage) cooled to a first temperature for example of between 4 and 100 K (and for example equal to 50 K), and a second portion 17 (second stage) cooled to a second temperature of between 2 and 8 K (and for example equal to 4 K).

In addition, said injection line 12 is mechanically decoupled from the cryogenerator 4 and from the support 7, 8, that is to say that the injection line 12 is at least partially mechanically insulated from the vibrations generated by the cryogenerator 4.

Thus, the injection line 12 is not mechanically connected or fixed to the cryogenerator 4 directly, or to an element linked to the cryogenerator 4, without damping of the vibrations of the latter. For example, the injection line 12 is fixed to the enclosure 9, without contact with the support 7, 8. Alternatively or cumulatively, the injection line 12 is fixed to an element in the sheath 90, said element being mechanically insulated from the vibrations of the cryogenerator 4. For example, the injection line 12 passes through the support 8 without touching it and/or the enclosure 9 and/or the sheath 90 via an insulated passage with one or more vibration insulation systems (seals, dampers, etc.). In the sheath 90, the injection line 12 may be fixed to an inner wall of the sheath 90 (for example by welding and/or gluing) and/or may be suspended in the sheath 90. In particular, the injection line 12 is not in mechanical contact at the level of the plates 16, 17 (cold stage(s)) of the cryogenerator 4. The injection line 12 is thermally coupled to the cryogenerator 4 by virtue of the gas present in the enclosure 9 which houses the cryogenerator 4. A continuous heat exchanger is thus obtained allowing the effective pre-cooling of the mixture constituting the cycle gas, while avoiding the transmission of vibrations to the lower stages of the device 1.

As illustrated, the at least one cycle gas cooling member may further comprise an additional cooling system located upstream of the inlet of the boiler 5, for example a cooler 50 of the Joule-Thomson type (or any other appropriate system, for example a 1-K pot).

The working circuit 2 may further comprise a return line 13 connecting an outlet of the boiler 5 to an inlet of the transfer member 6 which is located outside the enclosure 9, via a fluid-tight passage in the enclosure 9. The return line 13 is also mechanically decoupled from the cryogenerator 4 and from the support 7, 8, that is to say at least partially mechanically insulated from the vibrations generated by the cryogenerator 4.

The return line 13 may be in heat exchange with the injection line 12 and/or with at least one heat exchanger in heat exchange with the injection line 12 in order to transfer cold energy from the cycle fluid of the return line 13 to the cycle fluid of the injection line 12 (for example at the plates or the exchangers 16, 17). For example, the return line 13 may be equipped with exchangers that are thermalized on the intermediate stages, between the stages, at 4 K and 300 K in order to recover the outgoing cold energy and to optimize the pre-cooling of the working fluid entering in the opposite direction.

As illustrated, the device 1 may comprise a source of gas 14 comprising helium-4 (4He) located outside the enclosure 9 and a supply line 15 connecting said source of gas 14 to the inside of the sheath 90 in a fluid-tight manner. The supply line 15 comprises a member 18 for controlling the gas flow rate (for example a valve) configured to control the quantity of gas in the sheath 90 and/or the pressure.

For example, the device may be configured to maintain the pressure in the sheath 90 at a determined value, for example close to atmospheric pressure and notably between 0 and 2 bar. For example, the target pressure is the liquefaction pressure of helium at the coldest temperature of the cryogenerator 4 (for example 5 K, 4 K, 2.5 K, etc.).

The embodiment of [FIG. 2] differs from that of [FIG. 1] in that the device 1 comprises a return line 19 connecting the sheath 90 to the source of gas 14 and a member for circulating the gas (compressor or other device) in order to generate a looped dynamic stream in sheath 90 via the supply line 15 and return line 19. That is to say that, contrary to the embodiment of [FIG. 1] in which the atmosphere in the sheath is static, in the embodiment of [FIG. 2] this atmosphere is dynamic.

The supply of gas to the volume surrounding the cryogenerator 4 (and the heat exchangers, if applicable) may thus be rendered dynamic. This makes it possible to use less gas and to be able to descend to lower temperatures more easily (lower than 4 K, and for example equal to 2.8 K). This is obtained by maintaining a gaseous atmosphere in the volume of the sheath around the cold part of the cryogenerator 4.

Alternatively, gas from this atmosphere may be liquefied and may form a bath at the bottom of the sheath 90.

The support may comprise a first base 8 mounted horizontally on a first set of legs 7, for example three legs (isostatic system).

As shown schematically in [FIG. 3], the support may comprise a second base 20 located under the first base 8 and mounted on a second set of legs 21, for example three legs. The two ends of the bellows 10 may be connected respectively to the first base 8 and second base 20. The second base 20 is for example connected to the first base 8 by the bellows 10, the enclosure 9 being for example mechanically connected to the second base 20.

This structure with dual isostatic frames makes it possible to better decouple the reactions of force and vibrations in the device 1.

The sets 7, 8 and 20, 21 may be fixed to the same reference surface or to two different respective reference surfaces.

Posts or pillars, for example three thereof, may also be provided in parallel with the bellows 10 to avoid any potential damage to the bellows 10 and the other components both during transport and during installation, maintenance and operation of the device 1. It is possible to use a horizontal clearance (in the XY plane) between each pillar and a respective flange to verify the correct alignment of the installation.

The vertical clearance (in Z) can be eliminated or enabled ("transport" mode or "operating" mode, for example). In "operating" mode, the vertical clearance can make it possible to release/optimize the work of the bellows 10 while maintaining a safety function which prevents the bellows 10 from being crushed in the event of failure.

The device has other advantages over the prior art. Thus, for example, improved ease of maintenance. Specifically, it suffices to disassemble (screws or other) at 300 K to be able to carry out work on the cryogenerator 4 on the support, by virtue of the absence of mechanical contact between the cryogenerator and the other cold elements of the device 1.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A dilution refrigeration device comprising:

a working circuit in the form of a loop containing a cycle fluid, the cycle fluid comprising a mixture of helium-3 and helium-4, the working circuit comprising a mixing chamber, a boiler and a pump, which are disposed in series and fluidically connected via a set of lines, the set of lines of the circuit being configured to connect an outlet of the mixing chamber to an inlet of the boiler and an outlet of the boiler to an inlet of the pump, the set of lines of the circuit also being configured to connect an outlet of the pump to an inlet of the mixing chamber;

at least one cooling member which is in heat exchange with the working circuit and is configured to transfer cold energy to the cycle fluid, the at least one cooling member comprising a cryogenerator;

a support;

a fluid-tight enclosure having an open end that is mechanically connected to the support via a fluid-tight flexible bellows;

an upper end of the cryogenerator being fixed to the support; and a fluid-tight sheath housed in the enclosure, wherein a lower end of the cryogenerator extends in the sheath inside the bellows such that the enclosure and the sheath are at least partially mechanically insulated from vibrations generated by the cryogenerator, wherein the circuit comprises a fluid injection line connecting the outlet of the pump to the inlet of the mixing chamber via a fluid-tight passage in the sheath, the injection line being in heat exchange with the cryogenerator and being mechanically decoupled from the cryogenerator and from the support, such that the injection line is at least partially mechanically insulated from the vibrations generated by the cryogenerator.

2. The device as claimed in claim 1, wherein the injection line is fixed to an inner wall of the sheath and/or suspended in the sheath.

3. The device as claimed in claim 1, wherein the circuit comprises a return line connecting the outlet of the boiler to the inlet of the pump outside the sheath, via a fluid-tight passage in the enclosure, the return line being mechanically decoupled from the cryogenerator and from the support, that is to say at least partially mechanically insulated from the vibrations generated by the cryogenerator.

4. The device as claimed in claim 3, wherein the return line is in heat exchange with the injection line and/or with at least one heat exchanger in heat exchange with the injection line in order to transfer cold energy from the cycle fluid circulating in the return line to the cycle fluid circulating in the injection line.

5. The device as claimed in claim 1, wherein the mixing chamber and the boiler are mounted in a shell and/or a container that are/is located in the enclosure, the pump being located outside the enclosure.

6. The device as claimed in claim 1, further comprising a source of gas comprising helium-4 located outside the enclosure and a supply line connecting said source of gas to the inside of the sheath in a fluid-tight manner.

7. The device as claimed in claim 6, wherein the supply line comprises a control valve configured to control the gas flow rate, thereby controlling the quantity of gas in the sheath.

8. The device as claimed in claim 6, further comprising a return line connecting the sheath to the source of gas and compressor configured to circulate the gas in order to generate a looped dynamic stream in sheath via the supply line and return line.

9. The device as claimed in claim 1, wherein, in an operating configuration, the lower end of the cryogenerator comprises a first portion cooled to a first temperature of between 4 and 100 K, and a second portion cooled to a second temperature of between 2 and 8 K.

10. A dilution refrigeration device comprising:

a working circuit in the form of a loop contain a cycle fluid, the cycle fluid comprising a mixture of helium-3 and helium-4, the working circuit comprising a mixing chamber, a boiler and a pump, which are disposed in series and fluidically connected via a set of lines, the set of lines of the circuit being configured to connect an outlet of the mixing chamber to an inlet of the boiler and an outlet of the boiler to an inlet of the pump, the set of lines of the circuit also being configured to connect an outlet of the pump to an inlet of the mixing chamber;

at least one cooling member which is in beat exchange with the working circuit and is configured to transfer cold energy to the cycle fluid, the at least one cooling member comprising a cyrogenerator;

a support;

a fluid-tight enclosure having an open end that is mechanically connected to the support via a fluid-tig ex die bellows;

an upper end of the cryogenerator being fixed to the support; and a fluid-tight sheath housed in the enclosure, wherein a lower end of the cryogenerator extends in the sheath inside the bellows such that the enclosure and the sheath are at least partially mechanically insulated from vibrations generated by the cryogenerator, wherein the circuit comprises a fluid infection line connecting e outlet of the pump to the inlet of the mixing chamber via a fluid-tight passage in the sheath, the injection line being in heat exchange with the cyrogenerator and being mechanically decoupled from the cryogenerator and from the support, such that the injection line is at least partially mechanically insulated from the vibration generated by the cryogenerator, wherein the at least one cooling member further comprises an additional cooling system located at the inlet upstream of the boiler, wherein the additional cooling system is a Joule-Thomson expansion valve.

11. The device as claimed in claim 1, wherein the support comprises a first base mounted on a first set of legs.

12. The device as claimed in claim 11, wherein the support comprises a second base located under the first base and mounted on a second set of legs, the two ends of the bellows being connected respectively to the first base and second base.

13. The device as claimed in claim 12, wherein the enclosure is mechanically connected to the second base.

14. A dilution refrigeration method using a device as claimed in claim 1, the method comprising the steps of:

generating cold by way of the cryogenerator;

circulating the cycle fluid in the working circuit;

wherein the method further comprises at least one step from among:

regulating the quantity of gas in the sheath;

regulating the pressure in the sheath to a determined value, that is close to atmospheric pressure and between 0 and 2 bar; and regulating the pressure in the sheath to a pressure corresponding to the liquefaction pressure of helium-4 at the coldest temperature of the cryogenerator.

* * * * *